United States Patent [19]

Monter

[11] Patent Number: 4,965,925

[45] Date of Patent: Oct. 30, 1990

[54] METHOD OF MAKING AN AXIAL MINIATURE FUSE WITH PLASTIC MOLDED BODY

[76] Inventor: John M. Monter, 920 Dutch Mill Dr., St. Louis, Mo. 63011

[21] Appl. No.: 339,881

[22] Filed: Apr. 17, 1989

Related U.S. Application Data

[60] Continuation of Ser. No. 123,825, Nov. 23, 1987, abandoned, which is a division of Ser. No. 31,489, Mar. 27, 1987, abandoned.

[51] Int. Cl.[5] ..... H01H 69/02

[52] U.S. Cl. ..... 29/623; 29/613; 29/460; 29/527.2; 264/266; 264/272.16; 264/272.18; 228/242; 228/214

[58] Field of Search ..... 29/623, 527.2, 527.3, 29/460, 613; 264/266, 272.16, 272.18; 228/242, 214; 337/186, 205

[56] References Cited

U.S. PATENT DOCUMENTS

| | | | |
|---|---|---|---|
| 3,200,471 | 8/1965 | Johnson et al. | 29/613 |
| 3,254,282 | 5/1966 | West | 427/410 |
| 3,914,863 | 10/1975 | Wiebe | 29/623 |
| 4,164,725 | 8/1979 | Wiebe | 29/623 |
| 4,189,083 | 2/1980 | Johnson et al. | 228/124 |
| 4,205,431 | 6/1980 | Wiebe | 29/623 |
| 4,370,292 | 1/1983 | Yanase et al. | 264/272.18 |
| 4,385,281 | 5/1983 | McAlear | 337/248 |
| 4,460,887 | 7/1984 | McAlear et al. | 337/186 |

*Primary Examiner*—P. W. Echols

[57] ABSTRACT

An improved electrical fuse having axial leads (5) and comprising a fuse wire in a cylindrical sleeve (2) supported at its ends by lead carrying end caps (3) is coated over the length of the fuse body by an adherent insulating layer of plastic (7). Improved humidity resistance and mechanical strength are achieved and control of coating thickness is improved. Use of hot plastic for the adherent insulating layer (7) reflows solder joint (4) reducing instances of open or high resistance fuses which must be rejected. Also, the $i^2t$ performance is significantly improved over other adherent coatings.

6 Claims, 2 Drawing Sheets

METHOD OF MAKING AN AXIAL MINIATURE FUSE WITH PLASTIC MOLDED BODY

RELATED APPLICATION

This is a continuation application of co-pending application Ser. No. 07/123,825 filed Nov. 23, 1987, now abandoned which is a divisional of co-pending application Ser. No. 031,489 filed on Mar. 27, 1987 now abandoned.

The present invention relates to an improvement in electrical fuses.

BACKGROUND OF THE INVENTION

Cartridge type electrical fuses having axial leads have been long known in the fuse art. The fuse element in such a fuse is typically a fusible wire centrally supported within a cylindrical sleeve forming a casing for the fuse. To insure reliable fusing it is essential that the fuse wire must not touch the interior wall of the sleeve along its length, hence, the ends of the fuse wire are supported in such a manner as to prevent such contact. External lead carrying end caps having solder therein are used to capture the fuse wire ends folded over the outside of the sleeve ends. Final mechanical assembly consists of press fitting the end caps over the folded-over ends of the fuse wire followed by momentary heating of the solder to obtain good electrical connection between the fuse wire and the end caps.

Since the fuse casing formed by the sleeve must form an insulated body, typically made of ceramic or glass, which cannot be easily solder bonded, the only substantial opposition to the separation of the end caps from the sleeve is derived from the pressure fitting of the end caps over the outer surface of the sleeve. Thus, such fuse structures are generally weak in tension, and are prone to mechanical failure on a pull test applied to the end leads. Such structures are prone to humidity induced corrosion problems because of the exposed metal end caps and the lack of any hermetic sealing.

Another problem with cartridge fuses is that a certain percentage of the fuses are defective due to failure to obtain good electrical connections between the fuse link and the end caps during the soldering process. These fuses must, of course, be discarded or reworked.

One prior art solution to the above problems comprises the application of a length of heat-shrinkable plastic tubing over the sleeve and end caps, the tubing overlapping, although loosely, the inner end of the leads and extending outwardly from the end caps. The heat shrunk tubing provides some improvement in fuse strength and provides a moderately good sealing for the fuse interior. A disadvantage of this construction is that the cap ends are exposed to the external ambient conditions, owing to the fact that the limited shrinkage capability of the tubing prevents a desired end cap sealing engagement of the heat shrunk tubing with the leads. Thus, it is necessary to plate the end caps to secure adequate corrosion resistance for these elements. The resulting structure is still not adequately strong, in that a moderate pull on the leads can still shift the end caps to break the fuse wire. Also, this type of fuse construction has no effect on the fuses which are defective due to improper solder connections.

Another prior art fuse which attempts to solve some of the above problems is comprised of a cartridge fuse having an insulating sleeve, end caps, and the adjacent portions of the power leads extending therefrom, coated with a high bond strength insulating material, as, for example, an epoxy material. Such a fuse is shown in U.S. Pat. No. 4,385,281. The bonded insulating coating covers and anchors the end caps to the casing-forming sleeve. However, problems with fuses defective due to poor solder connections are still present and epoxy will often crack or shatter at high temperatures.

BRIEF SUMMARY OF INVENTION

According to the present invention, a cartridge fuse comprised of a hollow cylindrical insulating body, end caps or ferrules enclosing the ends of the insulating cylinder, a fusible link connecting the ferrules, and leads attached to the ferrules for conducting current to and from the fuse, are encased in a high temperature insulating plastic. The insulating plastic is applied by insert injection molding and raises the temperature of the cartridge fuse to a temperature high enough to cause reflow of the solder joint connecting the fusible element and the ferrules or end caps. Thus, defective fuses due to improper solder connections in the manufacturing process are essentially eliminated. Additional benefits derived from the use of injection molded plastic coatings for cartridge fuses are an increase in the dimensional stability of the end product and the significant increase in the performance of the fuse, both in mechanical strength on fuse failure, and improved short circuit performance.

DETAILED DESCRIPTION OF THE INVENTION

Figure 1:
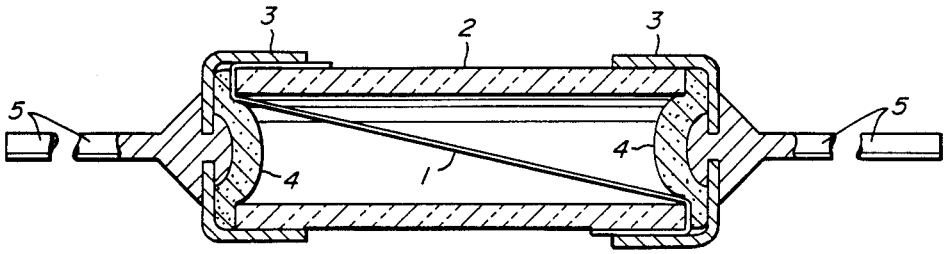
FIG. 1 is a partial longitudinal sectional view of a cartridge fuse.

Referring to the prior art fuse of FIG. 1, a length of fuse wire 1 is held captive at the ends of an initially open ended cylindrical sleeve 2 by means of a pair of cup-shaped end caps 3—3 having cylindrical interior recesses for receiving the ends of the sleeve 2 with a pressure fit. A body of solder 4 in each end cap 3 is heated to wet the fuse wire and secure it to the end caps 3—3. Shouldered connecting leads 5—5 pass through the center of the caps 3—3 and are secured by staking prior to assembly to the fuse structure.

Figure 2:
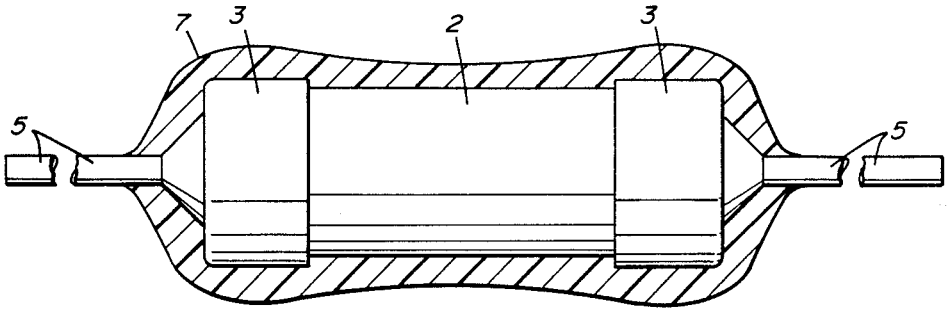
FIG. 2 is a partial cross-sectional elevation of a fuse as shown in FIG. 1, after the high bond strength plastic coating has been applied.

FIG. 2 shows the preferred form of the invention, wherein the fuse of FIG. 2 is coated with a high-bond strength plastic material or the like to achieve improved structural strength and a complete sealing of the sleeve 2 and end caps 3—3 against the adverse affects of moisture. In the preferred form of the invention the fuse is held in a mold and plastic is injected into the mold surrounding the cartridge fuse. This process is known as injection molding and is well-known in the art.

A number of plastics available commercially are suitable for use in practicing this invention. However, in order to cause reflow of the cap solder 4, the plastic should be injection molded at a temperature above approximately 220° F.

Use of injection molded plastic coatings has been found to have several significant beneficial effects. For example, using a mold with injection plastic, tolerances for the cylindrical body have been achieved on the order of ±0.002 inches. This compares to prior art tolerances of approximately ±0.02 inches using epoxy coatings.

Another improvement found with using injection molded plastic bodies has been an increase in the impact and flexural strength of the fuses. It has been found that plastic molded bodies such as described above can withstand the internal pressure generated inside a fuse during a 125v, 50 amp, 97% power factor short circuit. Internal pressures generated by such an overload will usually cause rupture of an epoxy fuse. This is perhaps due to the lower structural strength of epoxy coatings.

Figure 3:
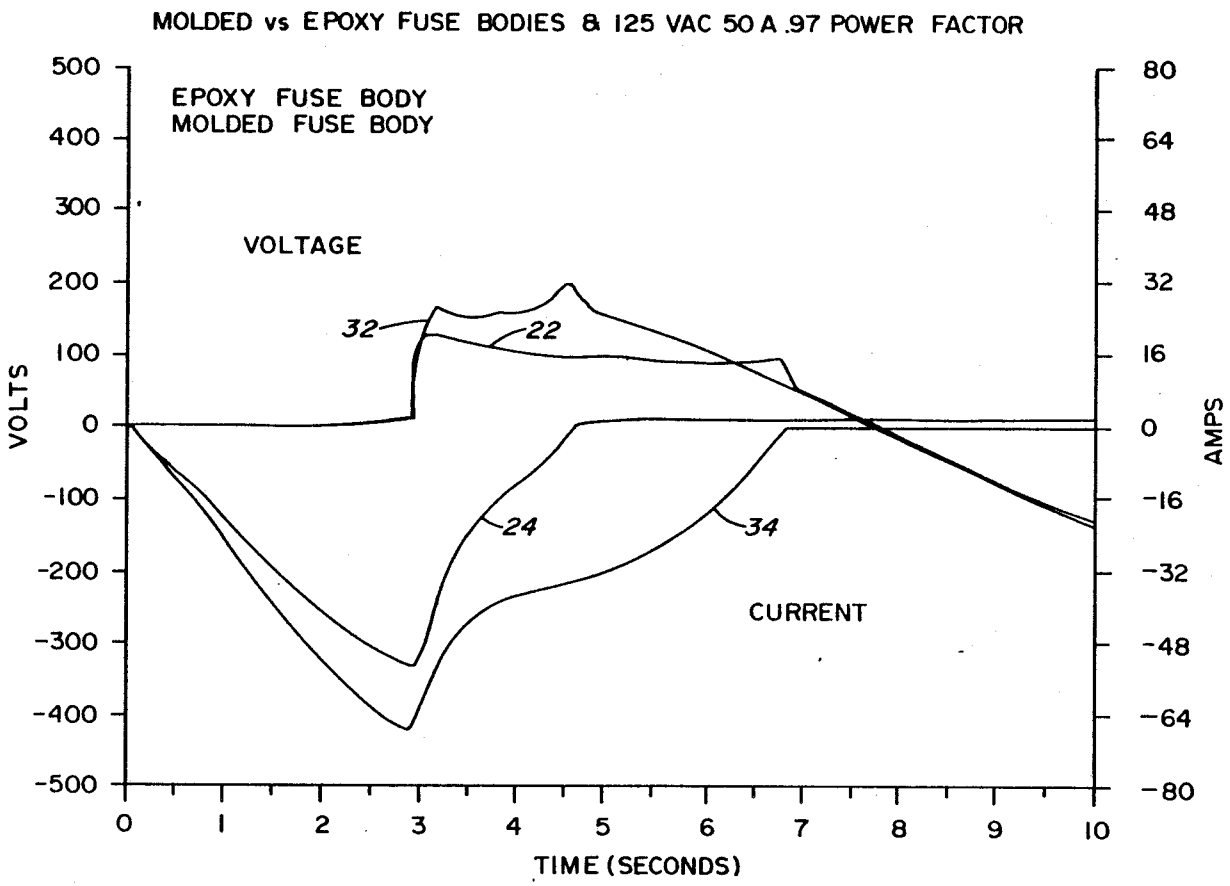
FIG. 3 is a graph showing the performance characteristics of a prior art fuse and a fuse according to the present invention.

A new and somewhat unexpected benefit of a plastic coated fuse as compared to prior art sleeve-type fuses and fuses coated with epoxy has been a significantly improved short circuit performance. As shown in FIG. 3, the performance of a plastic molded body fuse is appreciably better than the comparable performance of an epoxy coated fuse. In the tests that produced the graph results in FIG. 3, an epoxy coated fuse and a plastic coated fuse according to the present invention were subjected to a short circuit test in which 50 amps AC at 125v and 97% power factor, or essentially purely resistive circuit, were applied across the fuse. The voltage across and current through the plastic molded body fuse are shown at 22 and 24 respectively. The voltage across and current through an epoxy coated fuse are shown at 32 and 34 respectively. The most important information shown by these curves is the $i^2t$ value from the point at which the fuse opens. This value is represented by the area under the current curve for each particular fuse from the point where it begins its short break in an upward direction. In this particular test, the total $i^2t$ energy for the plastic molded body fuse was approximately 4.38 $amps^2$ seconds and for the epoxy coated body, approximately 9.53 $amps^2$ seconds.

In conclusion, it may readily be seen that a plastic molded body fuse has significantly improved short circuit performance, causes reflow of the solder joint during manufacture to reduce the number of rejected fuses, provides increased structural strength, and seals the fuse against moisture and humidity.

While the specific embodiment described is the preferred embodiment, it is readily apparent that other alterations may be made which fall within the scope of the present invention. For example, other high temperature materials other than plastic may be used which will cause reflow of the solder joint and provide structural strength and integrity to a cartridge type fuse or other type of fuse.

I claim:

1. A method of making an axial miniature fuse, comprising the steps of:

providing a cylindrical fuse having opposed conductive ends with connecting leads projecting outward therefrom, an insulating sleeve therebetween, a fusible link disposed between said conductive ends and connected to said ends with solder; and injection molding a plastic coating around the cylindrical fuse such that the fuse is encapsulated and the connecting leads project outward from said plastic coating.

2. The method of claim 1, wherein the connecting leads are staked to the end caps.

3. The method of claim 1, wherein said plastic molding disposed a radially uniform plastic coating about the fuse.

4. The method of claim 1, wherein the fusible link is folded over open ends of the insulated sleeve and the end caps are pressed over the sleeve to hold the fusible link in place.

5. The method of claim 1, wherein the solder connection holding the fusible link in place is reheated and reflows during the plastic molding step.

6. The method of claim 1, wherein the solder connection between the cap and fusible link is made during the plastic molding step.

* * * * *

UNITED STATES PATENT AND TRADEMARK OFFICE

CERTIFICATE OF CORRECTION

PATENT NO. : 4,965,925

DATED : October 30, 1990

INVENTOR(S) : John Monter

It is certified that error appears in the above—identified patent and that said Letters Patent is hereby corrected as shown below:

Claim 3, Column 4, line 28; delete "disposed" insert --disposes--.

Signed and Sealed this

Twenty-fifth Day of February, 1992

*Attest:*

HARRY F. MANBECK, JR.

*Attesting Officer*

*Commissioner of Patents and Trademarks*